US006322276B1

(12) United States Patent
Liu

(10) Patent No.: US 6,322,276 B1
(45) Date of Patent: Nov. 27, 2001

(54) PRESSURE RELEASE MECHANISM

(75) Inventor: Ruey-Shan Liu, Kaohsiung (TW)

(73) Assignee: Chung-Shan Institute of Science and Technology (TW)

( * ) Notice: Subject to any disclaimer, the term of this patent is extended or adjusted under 35 U.S.C. 154(b) by 0 days.

(21) Appl. No.: 09/536,733

(22) Filed: Mar. 28, 2000

(51) Int. Cl.[7] ..... F16D 3/80

(52) U.S. Cl. ..... 403/31; 403/164; 403/326; 403/DIG. 3; 403/DIG. 4; 403/DIG. 6

(58) Field of Search ..... 403/31, 32, 164, 403/326, 327, 328, DIG. 3, DIG. 4, DIG. 6

(56) References Cited

U.S. PATENT DOCUMENTS

| | | | | |
|---|---|---|---|---|
| 3,694,011 | * | 9/1972 | Silverman | 403/328 |
| 4,277,934 | * | 7/1981 | Rieck | 403/328 |
| 4,508,468 | * | 4/1985 | Irwin | 403/328 |
| 5,410,785 | * | 5/1995 | Huang | 403/328 |
| 5,692,851 | * | 12/1997 | Pace | 403/31 |

* cited by examiner

*Primary Examiner*—Lynne H. Browne
*Assistant Examiner*—Aaron Dunwoody
(74) *Attorney, Agent, or Firm*—Wolf, Greenfield & Sacks, P.C.; James H. Morris

(57) ABSTRACT

A pressure release mechanism has a securing end, a detaching end and an activation piston. An inner cylinder and an outer cylinder in communication with the inner cylinder are defined in the securing end. A concave annular recess is defined in the inner periphery of the outer cylinder. A spring is compressed in the inner cylinder. The activation piston has a first extension and a second extension respectively extending from opposite ends and an annular groove defined to receive therein an O-ring. Multiple holes ate radially defined in the detaching end to receive balls. A cylinder in communication with the outer cylinder of the securing end is defined in the detaching end, and an axial hole is defined in the detaching end to communicate with the cylinder and the external environment. When the activation piston is movably received in the detaching end cylinder and the securing end outer and inner cylinders, the balls in the holes are held in the concave annular recess. When the balls are released from the annular recess due to the movement of the first extension, the securing end is detached from the detaching end.

5 Claims, 5 Drawing Sheets

PRESSURE RELEASE MECHANISM

BACKGROUND OF THE INVENTION

1. Field of the Invention

The present invention relates to a pressure release mechanism, and more particularly to a pressure release mechanism that is simple in structure and reliable at great pressure. The pressure release mechanism uses pressure difference to move a activating piston to release the restrain on balls received in the head, which disconnect the engagement between the head and the body to perform the desired purpose.

2. Description of Related Art

Currently, to deploy a sensitive or fragile object in the water, a cable with a hook attached to the free end of the cable is used to lift the object into the air and then lower the object into the water. When the object reaches a predetermined depth, divers or other auxiliary equipment or facilities are required to release the object from the hook, which will either endanger the divers because of the water pressure or not be cost effective because of the equipment or facilities required.

To overcome the problems, another release device was introduced. With reference to FIG. 5, the release device has a body (70) with a chamber (71) defined inside the body (70). The chamber (71) movably houses receiving a driving rod (72) and a driven rod (74). A recess (741) is defined in the driven rod (74) to receive the head (721) of the driving rod (72). Multiple notches (742) are defined in the inner surface defining the recess (741) to receive a ball (75) in each notch (742). The diameter of the head (721) is larger than the diameter of the driving rod (72), such that when the head (721) is in the recess (741), the outer periphery of the head (721) abuts the balls (75) that are securely held in the respective notches (742). A diaphragm (731) is mounted on the end of the chamber at the free end of the driving rod (72) and is securely held in place by a cover (73). The cover (73) has multiple openings (732) defined to allow the external environment to communicate with the diaphragm (731). A first hook (701) is integrally formed on the body (70), and a second hook (702) is pivotally engaged with the first hook (701) to form an eye. A lever arm (703) extends from the bottom of the second hook (702) and is in contact with the free end of the driven rod (74). The free end of the driven rod (74) held in position by the balls (75) in the notches presses the extension (703) and holds the first and second hooks (701,702) to keep the eye closed.

When the conventional release mechanism is lowered into the water, water enters the openings (732) and exerts pressure on the diaphragm (731). As the water depth increases, the water pressure acting on the diaphragm (731) causes the diaphragm (731) to deform and press against the distal end of the driving rod (72). When the driving rod (72) is displaced enough by the water pressure pressing on the diaphragm (731), the head (721) moves into the recess (741) and releases the balls (75) in the notches (742). This releases the force holding the free end of the driven rod (74) against the extension (703) on the second hook (702). The second hook (702) then pivots relative to the first hook (701), opens the eye and releases the chain (80) that was held in the eye. Releasing the chain (80) deploys the object attached to the pressure release device in the water.

Since the release mechanism is attached to the object deployed in the water likely not to be recovered for use again, the cost of fabrication and the complex structure of the release mechanism do not appear to be warranted.

Furthermore, movement of the balls (75) to allow the movement of the driven rod (74) to release the second hook (702) is an incidental rather than an initiated action. It may happen when the head (721) is pushed into the recess (741), and it may not. Virtually any obstruction of the second hook (702), the driving rod (72) or the extension (703) would cause the release device to fail to operate as intended. The diaphragm (731) is always a potential source of failure in a pressure device. A crack in the diaphragm (731) due to high pressure, testing or maintenance will cause the release device to fail. Improper seating of the diaphragm and sealing of the chamber (71) will also cause the release device to fail.

To overcome the shortcomings, the present invention tends to provide an improved pressure release mechanism to mitigate and obviate the aforementioned problems.

SUMMARY OF THE INVENTION

The main objective of the invention is to provide an improved and simplified pressure release mechanism having a securing end and a detaching end detachably engaged with each other. The securing end is connected to a cable or the like. The detaching end has multiple balls movably positioned around the contact surface to hold the detaching end inside the securing end. Movement of the balls out of the seat in the securing end releases the detaching end, which accomplishes the release function as required.

Another objective of the invention is to provide an improved pressure release mechanism that is simple in structure and cost effective to fabricate. This will ensure that even though the detaching end is lost when it goes to the bottom with the object to which it is attached, the cost to perform the release process is still worth while.

Still another objective of the invention is to provide an improved pressure release mechanism that can be adjusted to release at different water pressures (i.e. different depths of water) by placing a spring with an appropriate strength in the securing end. A stronger spring will cause the device to release at a deeper depth.

Other objects, advantages and novel features of the invention will become more apparent from the following detailed description when taken in conjunction with the accompanying drawings.

DETAILED DESCRIPTION OF PREFERRED EMBODIMENT

Figure 1:
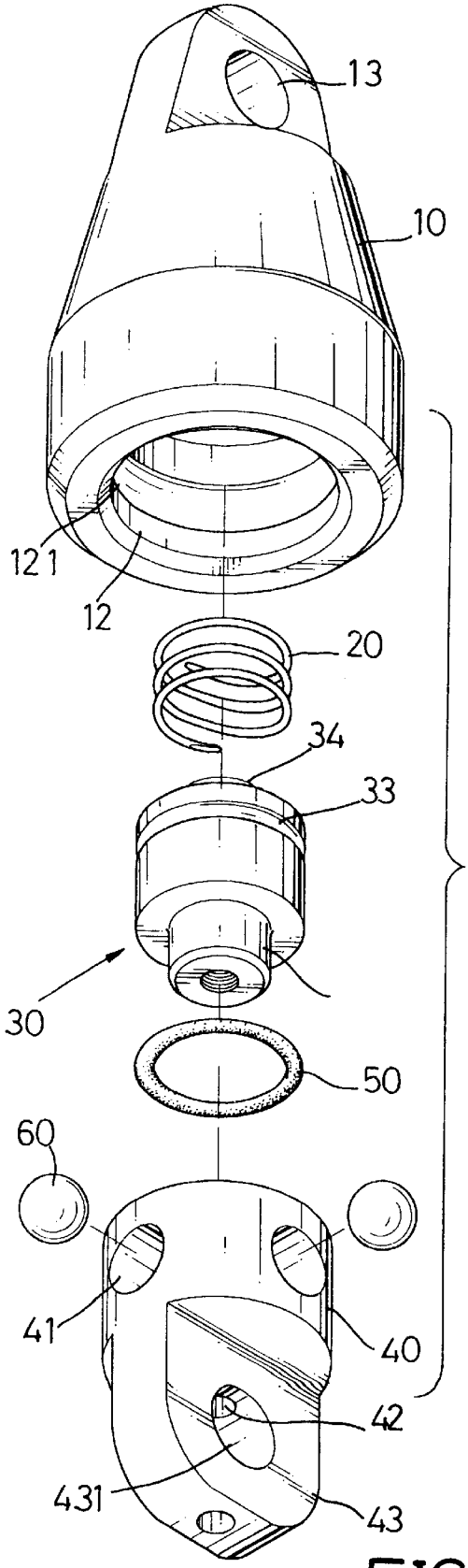
FIG. 1 is an exploded perspective view of the pressure release mechanism in accordance with the present invention.
Figure 2:
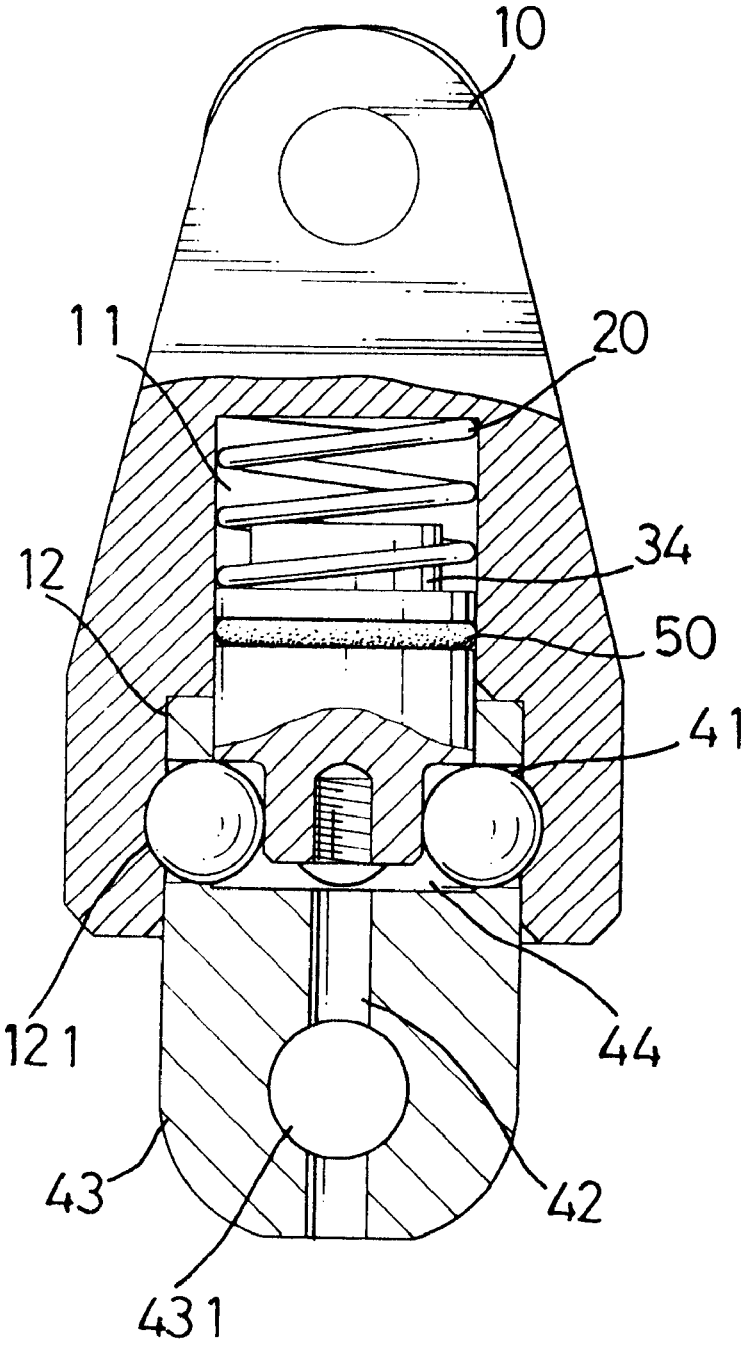
FIG. 2 is a side plan view in partial section of the pressure release mechanism in FIG. 1.

With reference to FIGS. 1 and 2, the pressure release mechanism in accordance with the present invention comprises a securing end (10), a spring (20), an activation piston (30), and a detaching end (40). The spring (20) is compressed in the securing end (10) and provides a counter force to the external pressure on the pressure release mechanism. The activation piston (30) abuts one end of the spring (20) and is the means to hold the two ends together. The detaching end (40) is detachably engaged with the securing end (10).

A chamber is formed in the securing end (10) that consists of an inner cylinder (11) and an outer cylinder (12) communicating with the inner cylinder (11). The outer cylinder (12) has a concave annular recess (121) defined in the inner periphery defining the outer cylinder (12). The inner cylinder (11) has a diameter smaller than that of the outer cylinder (12), and the spring (20) is snugly and compressed between the closed end of inner cylinder (11) and the activation piston (30). An eye (13) is formed in one end of the securing end (10) to facilitate the attachment of a cable or the like.

The activation piston (30) has a first extension (32) and a second extension (34) respectively extending out of opposite ends of the activation piston (30). An annular groove (33) is defined in the activation piston (30) between the first and the second extensions (32, 34) to seat an O-ring (50). The outer diameter of the activation piston (30) is slightly smaller than that of the inner cylinder (11), such that the O-ring (50) in the annular groove (33) forms a watertight seal between the activation piston (30) and the inner cylinder (11). The second extension (34) serves as a seat to hold one end of the spring (20) with the other end of the spring (20) abutting the bottom face of the inner cylinder (11).

The detaching end (40) has a central cylinder (44), multiple radial holes (41), an axial through hole (42) and a pad (43). The central cylinder (44) is formed in one end of the detaching end (40). The axial holes (41) are defined in the outer periphery of the detaching end (40) that is inserted into the outer cylinder (12) of the securing end (10) and communicate with the central cylinder (44). Each hole movably receives a ball (60). An axial hole (42) is defined in the end of the detaching end (40) opposite to the central cylinder (44) to allow the central cylinder (44) to communicate with the external environment. The cylinder (44) has a diameter slightly larger than that of the first extension (32) of the activation piston (30) to allow the first extension (32) to be movably received therein. An eye (431) is defined in the pad (43) to facilitate the attachment of an object.

When the mechanism is assembled, the spring (20) is sandwiched between the bottom face of the inner cylinder (11) and the second extension (34). A ball (60) is inserted into each radial hole (41) in the detaching end (40), and the detaching end (40) is inserted into the outer cylinder (12) of the securing end (10) such that the first extension (32) is received in the cylinder (44) in the detaching end (40) until the balls (60) abut the end of the first extension (32). Continuing to press the detaching end (40) compresses the spring (20). When the balls (60) seat in the concave annular recess (121), the end of the first extension (32) is released and the spring (20) pushes the first extension (32) into the cylinder (44) in the detaching end (40). With the first extension (32) fully extended into the cylinder (44) of the detaching end (40), the end of the first extension (32) holds the balls (60) in concave annular recess, which locks the detaching end (40) in the securing end (10). With the first extension (32) received in the cylinder (44) of the detaching end (40) and watertight seal between the activation piston (30) and the wall of the inner cylinder (11) of the securing end (10), the pressure release mechanism reacts to differences in external environmental pressure.

Figure 3:
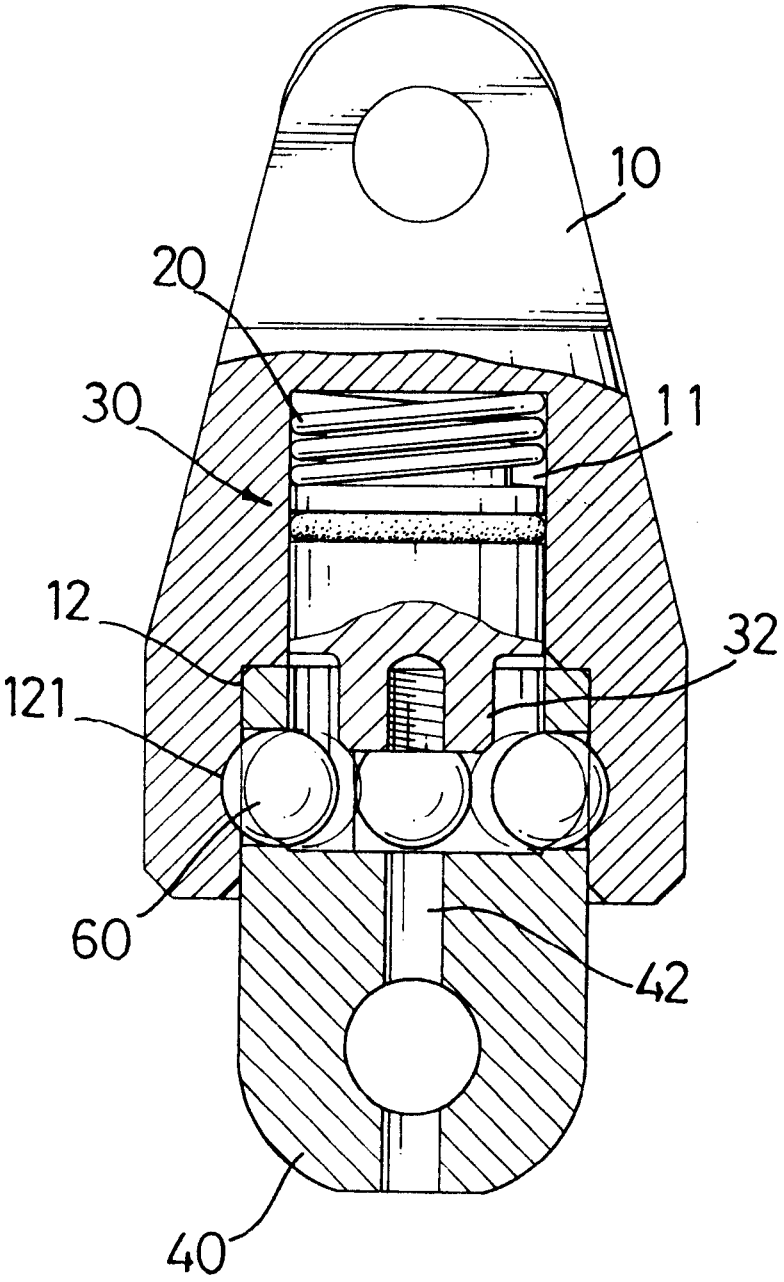
FIG. 3 is an operational side plan view in partial cross section of the pressure release mechanism in FIG. 1, wherein the balls move out of their engagement position due to the movement of the activation piston.
Figure 4:
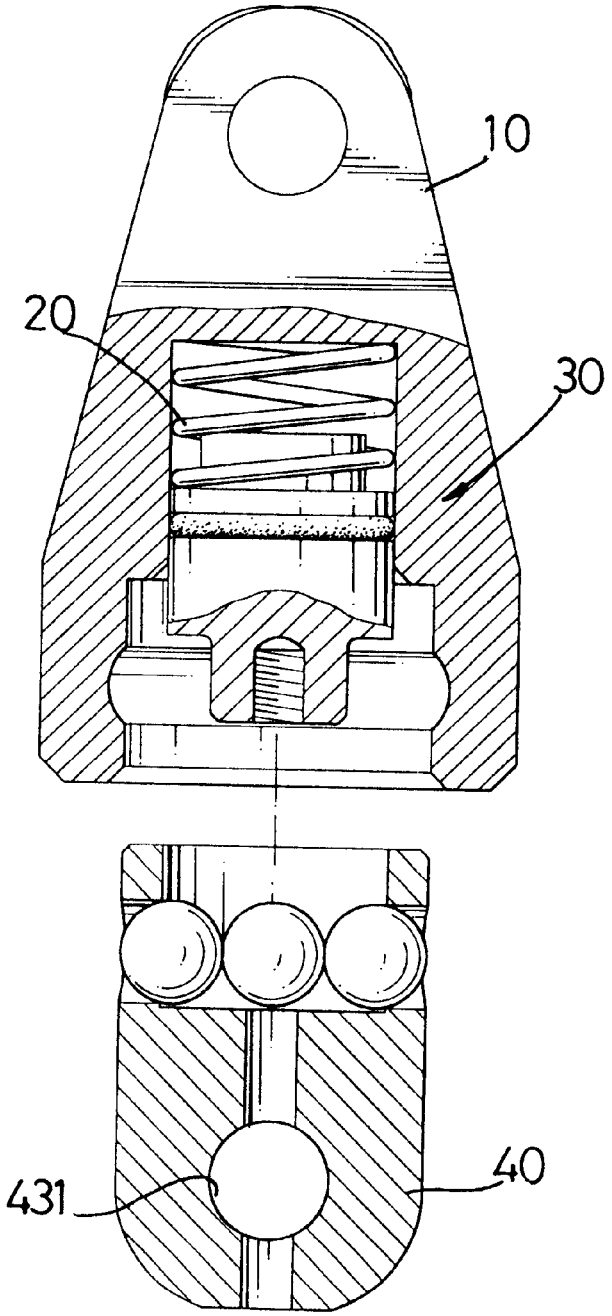
FIG. 4 is an operational side plan view in partial section of the pressure release mechanism in FIG. 1, where the securing end and the detaching end are detached from each other.
Figure 5:
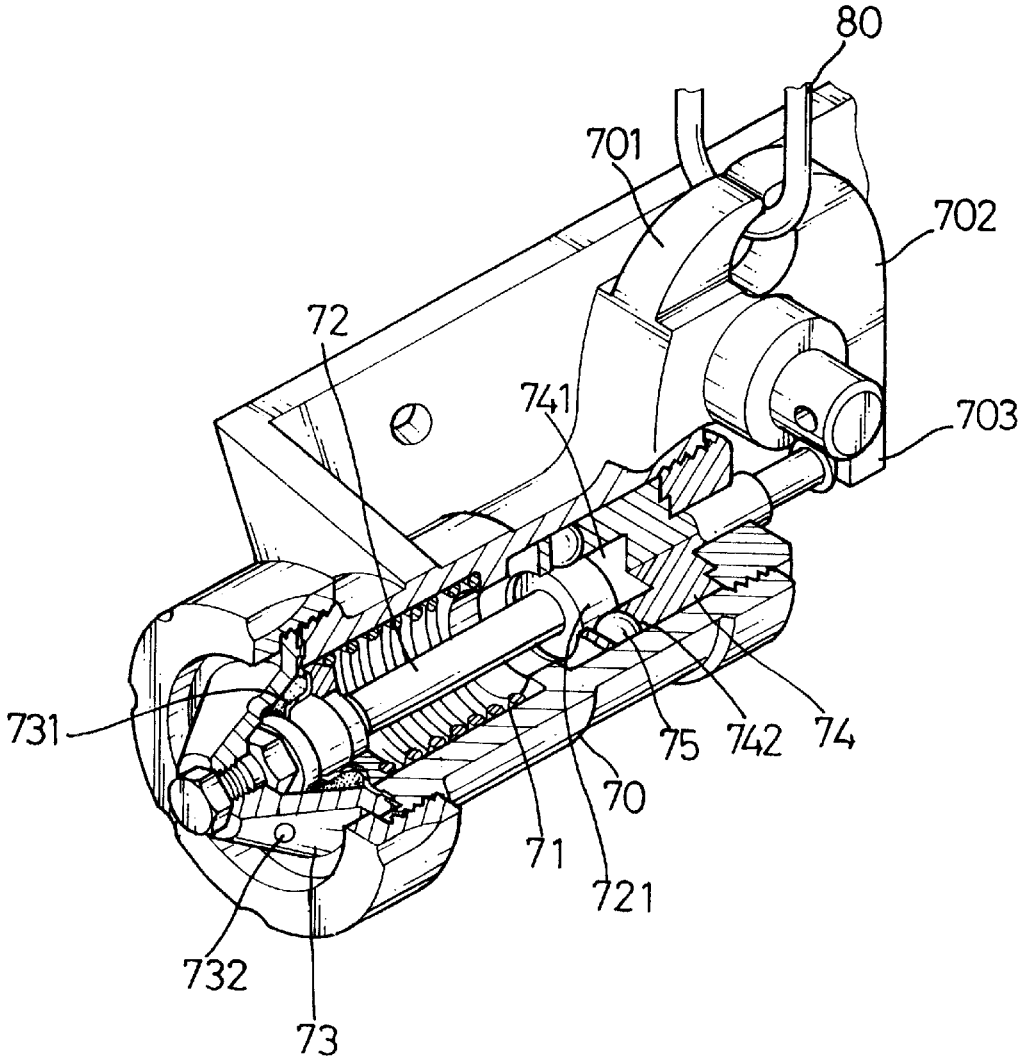
FIG.5 PRIOR ART
FIG. 5 is a perspective view in partial section of a conventional pressure release mechanism.

With reference to FIG. 3, when the pressure release mechanism is lowered into the water, the water pressure will act on the waterside surfaces of the activation piston (30). The increased external pressure presses the activation piston (30) together with the first extension (32) into the inner cylinder (11) against the force of the spring (20). As the water pressure increases, the activation piston (30) is pushed into the inner cylinder (11) and compresses the spring (20). As the end of the first extension (32) moves out of the cylinder (44) in the detaching end (40), the restraint on the balls (60) holding them in the concave annular recess (121) by the first extension (32) vanishes. With no restraining force to hold the balls (60) in the concave annular recess (121), the weight of the object attached to the detaching end (40) causes the balls (60) to move out of the concave annular recess (121) and release the restraining force holding the detaching end (40) in the securing end (10). When the balls (60) move clear of the concave annular recess (121), the detaching end (40) detaches from the securing end (10). With reference to FIG. 4, when the detaching end (40) detaches from the securing end (10), the object connected to the eye (431) of the detaching end (40) is deployed in the water.

It is to be understood, however, that even though numerous characteristics and advantages of the present invention have been set forth in the foregoing description, together with details of the structure and functions of the invention, the disclosure is illustrative only, and changes may be made in detail, especially in matters of shape, size, and arrangement of parts within the principles of the invention to the full extent indicated by the broad general meaning of the terms in which the appended claims are expressed.

What claimed is:

1. A pressure release mechanism comprising:

a securing end defining therein an inner cylinder, an outer cylinder communicating with the inner cylinder and an annular recess defined on the inner periphery defining the outer cylinder;

an activation piston having a first extension and a second extension respectively extending out from opposite ends of the activation piston and an annular groove defined in the activation piston to receive an O-ring, wherein the activation piston has a diameter slightly smaller than that of the inner cylinder;

a spring compressed between the inner cylinder and the activation piston; and a detaching end detachably engaged with the securing end and having multiple holes radially defined therein to respectively and movably receive a ball in each hole, which is selectively received in the annular recess of the securing end, a cylinder defined to communicate with the holes and to receive therein the first extension to abut the balls in the respective holes, a through hole defined to communicate with the holes and the cylinder;

whereby a water pressure acting on the waterside of the activation piston through the through hole of the detaching end will move the activation piston into the inner cylinder to release the contact between the end of the first extension and the balls that are then detached from the annular recess, which allows the detachment between the securing end and the detaching end.

2. The mechanism as claimed in claim 1, wherein the securing end has an eye defined therein, such that the securing end is able to attach to a cable.

3. The mechanism as claimed in claim 1, wherein the detaching end has an eye defined therein, such that the detaching end is able to attach to an object that is to be deployed in the water.

4. The mechanism as claimed in claim 1, wherein the inner cylinder has a diameter smaller than that of the outer cylinder.

5. The mechanism as claimed in claim 1, wherein the activation piston has a diameter slightly smaller than that of the inner cylinder so as that the activation piston is able to have a watertight seal with the inner cylinder after an O-ring is install in an annular groove in the activation piston.

* * * * *